United States Patent [19]

Dedio et al.

[11] Patent Number: 4,857,439

[45] Date of Patent: Aug. 15, 1989

[54] PHOTOTHERMOGRAPHIC ELEMENT AND PROCESS

[75] Inventors: Edward L. Dedio, Pittsford; John W. Reeves, Rochester, both of N.Y.

[73] Assignee: Eastman Kodak Company, Rochester, N.Y.

[21] Appl. No.: 177,558

[22] Filed: Apr. 4, 1988

[51] Int. Cl.[4] ..... G03C 1/06

[52] U.S. Cl. ..... 430/349; 430/619; 430/620

[58] Field of Search ..... 430/349, 619, 620

[56] References Cited

U.S. PATENT DOCUMENTS

| | | | |
|---|---|---|---|
| 3,457,075 | 7/1969 | Morgan et al. | 430/619 |
| 3,816,132 | 6/1974 | Tukegawa et al. | 430/620 |
| 3,933,508 | 1/1976 | Ohkubo et al. | 430/523 |
| 4,287,295 | 9/1981 | Nonaka et al. | 430/349 |
| 4,332,889 | 6/1982 | Siga et al. | 430/349 |
| 4,395,484 | 7/1983 | McCarney | 430/620 |
| 4,459,350 | 7/1984 | Przezdziecki | 430/353 |

OTHER PUBLICATIONS

Research Disclosure No. 17029, *Research Disclosure*, vol. 170, 1978, Kenneth Mason Publications Ltd., Hampshire, England.

*Primary Examiner*—Richard L. Schilling
*Attorney, Agent, or Firm*—Richard E. Knapp

[57] ABSTRACT

A method of making a photothermographic silver halide element comprises the combination of (I) adding an alkyl carboxylic acid containing 8 to 22 carbon atoms to a layer of the element comprising photosensitive silver halide and (II) after preparation of the layer comprising silver halide and before exposure of the element to light heating the element uniformly at a temperature and for a time sufficient to enable the photothermographic element to exhibit increased latent image stability upon imagewise exposure to light. The photothermographic element includes photosensitive silver halide and an oxidation-reduction image forming combination in a polmeric binder. A developed visible image is provided in such a photothermographic element after exposure to light by uniformly heating the exposed photothermographic element to moderately elevated temperatures.

9 Claims, No Drawings

PHOTOTHERMOGRAPHIC ELEMENT AND PROCESS

This invention relates to a method of making a photothermographic silver halide element comprising a combination of steps that enable the resulting element to exhibit increased latent image stability upon exposure of the element to light. The invention also relates to a photothermographic element made by such a method.

Thermally processable imaging elements, including films and papers, for producing images by thermal processing are known. These elements include photothermographic elements in which an image is formed by imagewise exposure to light followed by development by uniformly heating the element. Such elements typically include photosensitive silver halide, prepared in situ and/or ex situ, as a photosensitive component, in combination with an oxidation-reduction image forming combination, such as silver behenate with a phenolic reducing agent. Such elements are described in, for example, *Research Disclosure,* June 1978, Item No. 17029; U.S. Pat. No. 3,457,075; and U.S. Pat. No. 3,933,508.

A problem exhibited by photothermographic silver halide elements, particularly photothermographic silver halide films designed for laser recording, is that the elements often exhibit lower latent image stability than desired. This problem is exhibited by a speed loss in the developed image when the photothermographic silver halide element is not uniformly heated to develop a visible image until several hours after imagewise exposure to form a latent image in a photosensitive layer of the element. This problem is illustrated in the following comparative examples.

A continuing need has existed for a method of making a photothermographic silver halide element that exhibits improved latent image stability properties without the need for addition of expensive addenda. A need has also existed for such a photothermographic element.

It has been found that the described increased latent image stability is provided by a method of making a photothermographic silver halide element comprising a support bearing at least one layer comprising (a) photosensitive silver halide, prepared in situ or ex situ;

(b) an oxidation-reduction image forming combination comprising (i) a silver salt of a carboxylic acid as an oxidizing agent, and (ii) a reducing agent for the silver salt of the carboxylic acid; and, (c) a polymeric binder, typically poly(vinyl butyral).

The method of making such an element that exhibits increased latent image stability comprises the combination of (I) adding an alkyl carboxylic acid comprising 8 to 22 carbon atoms at any stage of the preparation of the layer comprising photosensitive silver halide; and, (II) after preparation of the layer comprising photosensitive silver halide and before exposure of the element to light, uniformly heating the element to a temperature and for a time sufficient to enable the element to exhibit increased latent image stability. The heating step (II) is typically carried out at a temperature within the range of about 75° to 105° C., preferably within the range of 80° to 85° C.

The optimum time of heating in step (II) as described can vary depending upon the particular photothermographic element, the particular alkyl carboxylic acid, and the temperature of heating in step (II). Typically, the time of heating in step (II) is within the range of 60 to 210 seconds, such as 120 to 180 seconds.

The reaction that occurs in the element as a result of the heating step (II) when the alkyl carboxylic acid from (I) is present enables the resulting photothermographic element to exhibit increased latent image stability upon exposure of the photothermographic element to light.

The alkyl carboxylic acid that is added to the photothermographic element in step (I) is any alkyl carboxylic acid that contains 8 to 22 carbon atoms particularly 8 to 16 carbon atoms as illustrated in following Examples 1–6. The alkyl carboxylic acid can be a branched or unbranched alkyl carboxylic acid. It also can be unsubstituted or substituted with groups that do not adversely effect the desired properties of the element. Illustrative useful alkyl carboxylic acids include:

1. Octanoic
2. Lauric
3. Myristic
4. Palmitic
5. Stearic
6. Arachidic, and
7. Behenic Combinations of such alkyl carboxylic acids are also useful.

The alkyl carboxylic acids are compounds known in the organic synthesis art and are commercially available or can be prepared by methods known in this art.

Palmitic acid is a preferred alkyl carboxylic acid.

A useful concentration of the alkyl carboxylic acid in the photothermographic silver halide element is typically within the range of 1 to 100 grams of alkyl carboxylic acid per mole of total silver. A preferred concentration of alkyl carboxylic acid, such as palmitic acid, is within the range of 5 to 25 grams of alkyl carboxylic acid per mole of silver. The optimum concentration of alkyl carboxylic acid will vary depending upon the components in the photothermographic element, processing conditions, and the temperature of the heating step (II).

The method steps (I) and (II) are useful to improve latent image keeping stability in preparation of any photothermographic silver halide element comprising the components described and that is compatible with the alkyl carboxylic acid. The photothermographic silver halide element can be a black and white imaging element or a dye-forming photothermographic silver halide element, such as an element designed for dye image transfer to an image receiver layer. The method steps (I) and (II) are useful for preparation of elements described in, for example, U.S. Pat. Nos. 3,457,075; 4,459,350; 4,264,725 and *Research Disclosure,* June 1987, Item No. 17029. The method steps (I) and (II) are particularly useful in preparing a photothermographic silver halide element comprising a support bearing, in reactive association, in a binder, such as poly(vinyl butyral), (a) photosensitive silver halide, prepared ex situ and/or in situ, and (b) an oxidation-reduction image forming combination comprising (i) an organic silver salt oxidizing agent, preferably a silver salt of a long chain fatty acid, such as silver behenate, with (ii) a reducing agent for the organic silver salt oxidizing agent, preferably a phenolic reducing agent. The photothermographic silver halide element can comprise other addenda known in the art to help in providing a useful image, such as optional toning agents and image stabilizers.

A preferred embodiment of the invention is a method of preparing a photothermographic silver halide element comprising steps (I) and (II) as described. A preferred photothermographic element prepared by such a process comprises a support bearing, in reactive association, in a binder, particularly a poly(vinyl butyral) binder, (a) photographic silver halide, prepared in situ and/or ex situ, (b) and oxidation-reduction image forming combination comprising (i) silver behenate, with a (ii) a phenolic reducing agent for the silver behenate, (c) a toning agent, such as succinimide, and (d) an image stabilizer, such as 2-bromo-2-(4-methylphenylsulfonyl-)acetamide.

The photothermographic element typically has an overcoat layer that helps protect the element from undesired marks. Such an overcoat can be, for example, a polymer as described in the photothermographic art. Such a overcoat can also be a overcoat comprising poly(silicic acid) and poly(vinyl alcohol) as described in copending U.S. patent application Ser. No. 910,033 filed Sept. 22, 1986, now issued as U.S. Pat. No. 4,741,992, the disclosure of which is incorporated by reference.

The optimum layer thickness of the layers of th photothermographic element depends upon such factors as the processing conditions, thermal processing means, particular components of the element and the desired image. The layers typically have a layer thickness within the range of about 1 to about 10 microns.

The photothermographic element comprises a photosensitive component that consists essentially of photographic silver halide. In the photothermographic element it is believed that the latent image silver from the photographic silver halide acts as a catalyst for the described oxidation-reduction image forming combination upon processing. A preferred concentration of photographic silver halide is within the range of about 0.01 to about 10 moles of silver halide per mole of silver behenate in the photothermographic element. Other photosensitive silver salts are useful in combination with the photographic silver halide if desired. Preferred photographic silver halides are silver chloride, silver bromide, silver bromoiodide, silver chlorobromoiodide and mixtures of these silver halides. Very fine grain photographic silver halide is especially useful. The photographic silver halide can be prepared by any of the procedures known in the photographic art. Such procedures for forming photographic silver halide forms of such silver halide are described in, for example, Research Disclosure, December 1978, Item No. 17643 and Research Disclosure, June 1978, Item No. 17029. Tabular grain photosensitive silver halide is also useful, such as described in, for example, U.S. Pat. No. 4,453,499.

The photographic silver halide can be unwashed or washed, chemically sensitized, protected against production of fog and stabilized against loss of sensitivity during keeping as described in the above Research Disclosure publications. The silver halide can be prepared in situ as described in, for example, U.S. Pat. No. 3,457,075. Optionally the silver halide can be prepared ex situ as known in the photographic art.

The photothermographic element typically comprises an oxidation-reduction image forming combination that contains an organic silver salt oxidizing agent, preferably a silver salt of a long-chain fatty acid. Such organic silver salt oxidizing agents are resistant to darkening upon illumination. Preferred organic silver salt oxidizing agents are silver salts of long-chain fatty acids containing 10 to 30 carbon atoms. Examples of useful organic silver oxidizing agents are silver behenate, silver stearate, silver oleate, silver laurate, silver caprate, silver myristate, and silver palmitate. Combinations of organic silver salt oxidizing agents are also useful. Examples of useful silver salt oxidizing agents that are not silver salts of fatty acids include, for example, silver benzoate and silver benzotriazole.

The optimum concentration of organic silver salt oxidizing agent in the photothermographic material will vary depending upon the desired image, particular organic silver salt oxidizing agent, particular reducing agent, particular fatty acids in the photothermographic composition, and the particular photothermographic element. A preferred concentration of organic silver salt oxidizing agent is typically within the range of 0.5 mole to 0.90 mole per mole of total silver in the photothermographic element. When combinations of organic silver salt oxidizing agents are present, the total concentration of organic silver salt oxidizing agents is within the described concentration range.

A variety of reducing agents are useful in the oxidation-reduction image forming combination. Examples of useful reducing agents include substituted phenols and naphthols such as bis beta-naphthols; polyhydroxybenzenes, such as hydroquinones; catechols and pyrogallols; aminophenol reducing agents, such as 2,4-diaminophenols and methylaminophenols, ascorbic acid, ascorbic acid ketals and other ascorbic acid derivatives; hydroxylamine reducing agents; 3-pyrazolidone reducing agents; sulfonamidophenyl reducing agents, such as described in U.S. Pat. No. 3,933,508 and Research Disclosure, June 1978, Item No. 17029. Combinations of organic reducing agents are also useful.

Preferred organic reducing agents in the photothermographic materials are sulfonamidophenol reducing agents, such as described in U.S. Pat. No. 3,801,321. Examples of useful sulfonamidophenol reducing agents include 2,6-dichloro-4-benzensulfonamidophenol; benzenesulfonamidophenol; 2,6-dibromo-4-benzenesulfonamidophenol and mixtures thereof.

An optimum concentration of reducing agent in a photothermographic material varies depending upon such factors as the particular photothermographic element, desired image, processing conditions, the particular organic silver salt oxidizing agent and manufacturing conditions for the photothermographic material. A particularly useful concentration of organic reducing agent is within the range of 0.2 mole to 2.0 mole of reducing agent per mole of silver in the photothermographic material. When combinations of organic reducing agents are present, the total concentration of reducing agent is preferably within the described concentration range.

The photothermographic material preferably comprises a toning agent, also known as an activator-toning agent or a toner-accelerator. Combinations of toning agents are useful in photothermographic materials. An optimum toning agent or toning agent combination depends upon such factors as the particular photothermographic material, desired image and processing conditions. Examples of useful toning agents and toning agent combinations include those described in, for example, *Research Disclosure,* June 1978, Item No. 17029 and U.S. Pat. No. 4,123,282. Examples of useful toning agents include phthalimide, N-hydroxyphthalimide, N-potassiumphalimide, succinimide, N-hydroxy-1,8-naphthalimide, phthalazine, 1-(2H)-phthalazinone and 2-acetyphthalazinone.

Stabilizers are also useful in the photothermographic material. Examples of such stabilizers and stabilizer precursors are described in, for example, U.S. Pat. No. 4,459,350, and U.S. Pat. No. 3,877,940. Such stabilizers include photolytically active stabilizers and stabilizer precursors, azole thioethers and blocked azolinethione stabilizers precursors and carbamoyl stabilizer precursors.

Photothermographic materials are described preferably contain various colloids and polymers alone or in combination as vehicles, binding agents and in various layers. Useful materials are hydrophobic or hydrophilic. They are transparent or translucent and include both naturally occurring substances such as proteins, for example, gelatin, gelatin derivatives, cellulose derivatives, polysaccharides, such as dextran, gum arabic and the like; and synthetic polymeric substances, such as polyvinyl compounds like poly(vinylpyrrolidone) and acrylamide polymers. Other synthetic polymeric compounds that are useful include dispersed vinyl compounds such as in latex form and particularly those that increase the dimensional stability of photographic materials. Effective polymers include polymers of alkylacrylates and methacrylates, acrylic acid, sulfoacrylates and those that have cross-linking sites that facilitate hardening or curing. Preferred high molecular weight polymers and resins include poly(vinylbutyral), cellulose acetate butyrals, poly(methylmethacrylate), poly(vinylpyrrolidone), ethyl cellulose, polystyrene, poly(vinylchloride), chlorinated rubbers, polyisobutylene, butadiene-styrene copolymers, vinyl chloride-vinyl acetate copolymers, poly(vinyl alcohols) and polycarbonates.

The photothermographic materials can contain development modifiers that function as speed increasing compounds, sensitizing dyes, hardeners, antistatic layers, plasticizers and lubricants, coating aids, brighteners, absorbing and filter dyes, and other addenda, such as described in *Research Disclosure,* June 1978, Item No. 17029 and *Research Disclosure,* December 1978, Item No. 17643.

The photothermogrphic elements as described comprise a variety of supports. Examples of useful supports include poly(vinylacetal) film, polystyrene film, poly(ethyleneterephthalate) film, polycarbonate films and related films and resinous materials, as well as glass, paper, metal, and other supports that can withstand the thermal processing temperatures.

The layers of the photothermographic element are coated on a support by coating procedures known in the photographic art, including dip coating, air knife coating, curtain coating or extrusion coating using hoppers. If desired, two or more layers are coated simultaneously.

Spectral sensitizing dyes are useful in the photothermographic materials. to confer added sensitivity to the elements and compositions. Useful sensitizing dyes are described in, for example, *Research Disclosure,* June 1978, Item No. 17029 and *Research Disclosure,* December 1978, Item No. 17643.

A photothermographic element, as described, also preferably comprises a thermal stabilizer to help stabilize the photothermographic element prior to imagewise exposure and thermal processing. Such a thermal stabilizer aids improvement of stability of the photothermographic element during storage. Typical thermal stabilizers are: (a) 2-bromo-2-arylsulfonylacetamides, such as 2-bromo-2-p-tolylsulfonylacetamide; (b) 2-(tribromomethyl sulfonyl)benzothiazole and (c) 6-substituted-2,4-bis(tribromomethyl)-s-triazine, such as 6-methyl or 6-phenyl-2,4-bis(tribromomethyl)-s-triazine.

The photothermographic element is imagewise exposed by means of various forms of energy. Such forms of energy include those to which the photosensitive silver halide is sensitive and include the ultraviolet, visible and infrared regions of the electromagnetic spectrum as well as electron beam and beta radiation, gamma ray, x-ray, alpha particle, neutron radiation, and other forms of wave-like radiant energy in either noncoherent (random phase) or coherent (in phase) forms as produced by lasers. Exposures are monochromatic, orthochromatic, or panchromatic depending upon the spectral sensitization of the photographic silver halide. Imagewise exposure is preferably for a sufficient time and intensity to produce a developable latent image in the photothermographic element. After imagewise exposure of the photothermographic element, the resulting latent image is developed merely by overall heating the element to moderately elevated temperatures. This overall heating merely involves heating the exposed photothermographic element to a temperature within the range of about 90 C. to about 150 C. until a developed image is produced, such as within the range of about 0.5 to about 60 seconds. By increasing or decreasing the length of time of heating, a higher or lower temperature within the described range is useful depending upon the desired image, the particular components of the photothermographic elememt and heating means. A preferred processing temperature is within the range of about 100 C. to about 130 C.

Heating means known in the photothermographic art are useful for providing the desired processing temperature. The heating means is, for example, a simple hot plate, iron, roller, heated drum, microwave heating means, heated air or the like.

Thermal processing is preferably carried out under ambient conditions of pressure and humidity. Conditions outside normal atmospheric conditions can be used if desired.

The components of the photothermographic element can be in any location in the element that provides the desired image. If desired, one or more of the components of the element are in one or more of the layers of the element. For example, in some cases, it is desirable to include certain percentages of the organic reducing agent, toner, stabilizer precursor and/or other addenda in an overcoat layer of the photothermographic element.

It is necessary that the components of the imaging combination be "in association" with each other in order to produce the desired image. The term "in association" herein means that in a photothermographic element the photosensitive silver halide and the image-forming combination are in a location with respect to each other that enables the desired processing and produces a useful image.

The following examples further illustrate the invention.

EXAMPLE 1

This illustrates the invention. The following components were mixed to form an emulsion (A):

| Component | Grams |
|---|---|
| Silver behenate dispersion (contains 19.4% by weight silver behenate in 8.5% by weight methyl isobutyl ketone (MIBK) solution of polyvinylbutyral (BUTVAR B-76 which is a trademark of and available from the Monsanto Co., U.S.A.)) (organic silver salt oxidizing agent) | 34.31 |
| Silver bromide (silver bromide emulsion contains 36.62 grams Ag/1 in 5% by weight MIBK solution of BUTVAR B-76) | 17.3 |
| Sodium iodide (4% by weight NaI in acetone) (speed increasing addendum) | 1.67 |
| Succinimide (10% by weight in 8.5% by weight acetone solution of BUTVAR B-76) (toner) | 7.97 |
| SF-96 (10% by weight SF-96 in MIBK. SF-96 is a silicone and is a tradename of General Electric Co., U.S.A.) (surfactant) | 0.15 |
| 2-bromo-2-(4-methylphenylsulfonyl) acetamide (2.5% by weight in 8.5% by weight acetone solution of BUTVAR B-76) (antifoggant) | 4.4 |
| 2,4-bis(trichloromethyl)-6-(1-naphthyl-s-triazine (2.5% by weight in 8.5% by weight acetone solution of BUTVAR B-76) (print-up stabilizer) | 1.1 |
| Sensitizing dye (0.1% by weight in 8.5% by weight acetone solution of BUTVAR B-76) | 8.66 |
| Benzenesulfonamidophenol (10% by weight in 8.5% by weight acetone solution of BUTVAR B-76) (developing agent) | 18.98 |
| BUTVAR-76 (8.5% by weight in acetone) (binder) | 1.21 |
| Palmitic acid (10% by weight in 8.5% by weight acetone solution of BUTVAR B-76) | 4.25 |

The resulting photothermographic silver halide composition was coated at a wet laydown of 60.4 grams/m$^2$ on a poly(ethyleneterephthalate) film support. The coating was permitted to dry and was then overcoated with the following overcoat composition:

| Component | Grams |
|---|---|
| Distilled water | 94.0 |
| Gelatin (binder) | 3.2 |
| Silica (1.3 micron particle size MIN-U-SIL which is available from and a trademark of Pennsylvania Glass and Sand Corp., U.S.A.) (matting agent) | 0.6 |
| Surfactant (Surfactant 10G which is para-isononylphenoxypolyglycidol and is a trademark of and available from the Olin Corp., U.S.A.) | 0.8 |
| Formaldehyde (40% by weight in water) (hardener) | 1.4 |

The resulting overcoat composition was coated over the dried photothermographic silver halide composition at a wet laydown of 45.6 grams/m$^2$. The coating was permitted to dry and was then heated in an air chamber at 82.2° C. for 2.0 minutes.

The resulting photothermographic element was imagewise exposed to light in a commercial sensitometer for $10^{-3}$ seconds to provide a developable latent image in the photothermographic element. The exposed photothermographic element was heated on a drum for 5 seconds at 119° C. to produce a developed silver image. The developed image had a maximum density of 2.96 and a minimum density of 0.18 with a relative Log E speed of 1.00 measured at a density of 1.0 above $D_{min}$.

A second sample of the above photothermographic element was similarly exposed but was kept in the dark at room temperature for 24 hours before being thermally processed for 5 seconds at 119° C. The developed image had a maximum density of 2.80 and a minimum density of 0.17 with a relative log speed of 0.92 measured at a density of 1.0 above $D_{min}$.

The speed difference (0.08 Log E) between the two samples is a measure of latent image fade after 24 hours.

EXAMPLE 2

Comparative Example

An emulsion (A) was prepared as described in Example 1 except that the palmitic acid was omitted. The resulting photothermographic composition was coated as described in Example 1 and was overcoated using the overcoat composition also described in Example 1. The coating was permitted to dry and was then heated in an air chamber at 65.5° C. for 2.0 minutes.

The resulting photothermographic element was exposed and processed immediately and exposed and processed after 24 hours. The latent image fade after 24 hours was measured to be 0.31 Log E.

EXAMPLE 3

Comparative Example

An emulsion (A) was prepared, coated and overcoated as described in Example 1 except that after the overcoat was permitted to dry the coating was heated in an air chamber at 65.5° C. for 2.0 minutes.

The latent image fade was measured as described in Example 1. The result is tabulated in Table I.

EXAMPLE 4

Comparative Example

An emulsion (A) was prepared, coated and overcoated as described in Example 2 except that after the overcoat was permitted to dry the coating was heated in an air chamber at 82.2° C. for 2.0 minutes.

The latent image fade was measured as described in Example 1. The result is tabulated in Table I.

TABLE I

| Example No. | Palmitic Acid Level mg/ft$^2$ | Cure Temp. °C. | 24 Hour Latent Image Fade |
|---|---|---|---|
| 2 (Comparison) | 0 | 65.5 | 0.31 Log E |
| 3 (Comparison) | 25.0 | 65.5 | 0.18 Log E |
| 4 (Comparison) | 0 | 82.2 | 0.25 Log E |
| 1 (Invention) | 25.0 | 82.2 | 0.08 Log E |

The results of Table I clearly demonstrate that increased cure temperature reduces the latent image fade. The results of Table I also demonstrate that the addition of palmitic acid to the photothermogrphic element also reduces latent image fade. The lowest level of latent image fade is achieved when palmitic acid is added to the photothermographic element and a temperature cure at a temperature within the range of 75° to 105° C. is used after the overcoat has been permitted to dry.

EXAMPLE 5

This illustrates the usefulness of other alkyl carboxylic acids.

An emulsion (A) was prepared as described in Example 1 except that the palmitic acid was omitted. To four equal portions of 95.75 grams each were added the following solutions:

| | |
|---|---|
| (a) BUTVAR B-76 (control) (8.5% by weight acetone solution of BUTVAR B-76) | 4.25 grams |
| (b) Palmitic acid solution (10% by weight in 8.5% by weight acetone solution of BUTVAR B-76) | 4.25 grams |
| (c) Lauric acid solution (7.8% by weight in 8.5% by weight acetone solution of BUTVAR B-76) | 4.25 grams |
| (d) Octanoic acid solution (5.6% by weight in 8.5% by weight acetone solution of BUTVAR B-76) | 4.25 grams |

The resulting four photothermographic silver halide compositions were coated as described in Example 1. The dried coatings were overcoated with the overcoat composition described in Example 1. The coatings were permitted to dry and were then heated in an air chamber at 82.2° C. for 2.0 minutes.

The latent image fade of the resulting four photothermographic elements was measured using the procedure described in Example 1. The results are tabulated in Table II.

TABLE II

| Example No. | Carboxylic Acid | 24 Hour Latent Image Fade |
|---|---|---|
| 5a | None (control) | 0.34 Log E |
| 5b | Palmitic | 0.05 Log E |
| 5c | Lauric | 0.06 Log E |
| 5d | Octanoic | 0.05 Log E |

The results indicate that several different alkyl carboxylic acids can be used to reduce the latent image fade.

EXAMPLE 6

The procedure described in Example 5b was repeated with the exception that sebacic acid $$(HOOC\text{-}(CH_2)_8\text{-}COOH)$$

was used in place of palmitic acid. The resulting photothermographic element exhibited improved latent image keeping properties compared to a control element containing no sebacic acid.

The invention has been described in detail with particular reference to preferred embodiments thereof, but it will be understood that variations and modifications can be effected within the spirit and scope of the invention.

What is claimed is:

1. A method of making a photothermographic element comprising a support bearing at least one layer comprising
   (a) photosensitive silver halide,
   (b) an oxidation-reduction image forming combination comprising
      (i) a silver salt of a carboxylic acid as an oxidizing agent and
      (ii) an organic reducing agent for the silver salt of the carboxylic acid, and
   (c) a polymeric binder, comprising the combination of
   (I) adding an alkyl carboxylic acid containing 8 to 16 carbon atoms at any stage of preparation of the layer, and
   (II) after preparation of said layer and before exposure to light, uniformly heating the layer to a temperature within the range of 75° C. to 105° C. for a time of 60 to 210 seconds.

2. A method of making a photothermographic element comprising a support bearing at least one layer comprising
   (a) photosensitive silver halide,
   (b) an oxidation-reduction image forming combination comprising
      (i) a silver salt of a carboxylic acid as an oxidizing agent and
      (ii) an organic reducing agent for the silver salt of the carboxylic acid, and
   (c) a polymeric binder, comprising the combination of
   (I) adding at least one of palmitic, lauric, octanoic and sebacic acid at any stage of preparation of the layer, and
   (II) after preparation of said layer and before exposure to light, uniformly heating the layer to a temperature within the range of 75° C. to 105° C. for a time of 60 to 210 seconds.

3. A method of making a photothermographic element comprising a support bearing at least one layer comprising
   (a) photosensitive silver halide,
   (b) an oxidation-reduction image forming combination comprising
      (i) a silver salt of a carboxylic acid as an oxidizing agent and
      (ii) an organic reducing agent for the silver salt of the carboxylic acid, and
   (c) a polymeric binder, comprising the combination of
   (I) adding palmitic acid at any stage of preparation of the layer, and
   (II) after preparation of said layer and before exposure to light, uniformly heating the layers to a temperature within the range of 75° C. to 105° C. for a time of 60 to 210 seconds.

4. A method of making a photothermographic silver halide element comprising a support bearing at least one layer comprising
   (a) photosensitive silver halide,
   (b) an oxidation-reduction image forming combination comprising
      (i) silver behenate,
      (ii) a phenolic silver reducing agent for the silver behenate, and
   (c) a poly(vinyl butyral) binder, comprising the combination of
   (I) adding palmitic acid at any stage of preparation of said layer, and
   (II) after preparation of said layer and before exposure to light uniformly heating the layer to a temperature within the range of 80° C. to 85° C. for a time of 120 to 180 seconds.

5. A photothermographic element prepared as in claim 3.

6. A photothermographic element prepared as in claim 4.

7. A photothermographic element prepared as in claim 1.

8. A photothermographic element prepared as in claim 2.

9. A method as in claim 3 wherein the heating step in (II) is within the temperature range of 80° C. to 85° C.

* * * * *